US009958812B2

(12) United States Patent
Yoshida et al.

(10) Patent No.: US 9,958,812 B2
(45) Date of Patent: May 1, 2018

(54) INTERMEDIATE TRANSFERRING BELT AND IMAGE-FORMING APPARATUS

(71) Applicant: Konica Minolta, Inc., Tokyo (JP)

(72) Inventors: Eiichi Yoshida, Hino (JP); Sadaaki Sakamoto, Hino (JP); Takayuki Suzuki, Niiza (JP); Ito Koga, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/178,087

(22) Filed: Jun. 9, 2016

(65) Prior Publication Data

US 2017/0010565 A1 Jan. 12, 2017

(30) Foreign Application Priority Data

Jul. 6, 2015 (JP) ..... 2015-135084

(51) Int. Cl.
*G03G 15/16* (2006.01)

(52) U.S. Cl.
CPC ... *G03G 15/162* (2013.01); *G03G 2215/0135* (2013.01)

(58) Field of Classification Search
CPC ..... G03G 15/1605; G03G 15/162; G03G 2215/0135
USPC ..... 399/302
See application file for complete search history.

(56) References Cited

U.S. PATENT DOCUMENTS

2009/0097888 A1* 4/2009 Hirai ..... G03G 15/1605 399/308
2012/0082488 A1* 4/2012 Kubo ..... G03G 15/162 399/302
2013/0084428 A1* 4/2013 Hayashi ..... G03G 15/0233 428/141
2014/0286682 A1* 9/2014 Sakamoto ..... G03G 15/162 399/302

FOREIGN PATENT DOCUMENTS

| | | | |
|---|---|---|---|
| JP | 2000-275976 A | | 10/2000 |
| JP | 2002214926 A | | 7/2002 |
| JP | 2004157289 A | | 6/2004 |
| JP | 2004361870 A | | 12/2004 |
| JP | 2005014440 A | * | 1/2005 |
| JP | 2005215238 A | * | 8/2005 |
| JP | 2009062499 A | | 3/2009 |
| JP | 2009069455 A | | 4/2009 |
| JP | 2010002567 A | * | 1/2010 |
| JP | 2010085450 A | * | 4/2010 |

(Continued)

OTHER PUBLICATIONS

Mamiya et al., Intermediate Transfer Body, JP2010-2567A, Jan. 2010, Detailed Description, English Machine Translations by JPO.*

(Continued)

*Primary Examiner* — Susan Lee
(74) *Attorney, Agent, or Firm* — Lucas & Mercanti, LLP

(57) ABSTRACT

The intermediate transferring belt is to be mounted in an electrophotographic image-forming apparatus. The intermediate transferring belt includes the following, in sequence, a substrate; an elastic layer; and a surface layer. The surface layer has an elongation of 5% or more and a stress of 5MPa or more at an elastic limit determined by a stress-strain curve obtained according to JIS K7161.

5 Claims, 2 Drawing Sheets

(56) References Cited

FOREIGN PATENT DOCUMENTS

| | | | |
|---|---|---|---|
| JP | 2012-073292 | A | 4/2012 |
| JP | 2012-247599 | A | 12/2012 |
| JP | 2015-014744 | A | 1/2015 |

OTHER PUBLICATIONS

Notification of Reasons for Refusal dated Jul. 18, 2017 from corresponding to Japanese Patent Application No. JP 2015-135084 and English translation.

* cited by examiner

INTERMEDIATE TRANSFERRING BELT AND IMAGE-FORMING APPARATUS

This application is based on Japanese Patent Application No. 2015-135084 filed on Jul. 6, 2015 with Japan Patent Office, the entire content of which is hereby incorporated by reference.

BACKGROUND OF THE INVENTION

Field of the Invention

The present invention relates to an intermediate transferring belt and an image-forming apparatus including the intermediate transferring belt.

Description of Related Art

In an electrophotographic image-forming apparatus, for example, a latent image formed on an image retainer (photoreceptor) is developed with a toner, the resultant toner image is temporarily retained on an endless intermediate transferring belt, and then the toner image on the intermediate transferring belt is transferred onto an image support, such as a sheet of paper.

An image-forming apparatus proposed for further improvement of image quality includes an intermediate transferring belt including a substrate and an elastic layer disposed on the substrate and composed of an elastic material, such as rubber. The intermediate transferring belt comes into close contact with a sheet of coarse paper and exhibits improved image transferability.

Unfortunately, the intermediate transferring belt has poor wear resistance because the exposed elastic layer is composed of a soft material such as rubber, and the surface of the transferring belt may be scraped during the use thereof.

A technique for solving such a problem involves coating of the elastic layer with a surface layer for protection (see Japanese Patent Application Laid-Open Publication Nos. 2009-069455, 2004-361870, 2004-157289, and 2002-214926).

Japanese Patent Application Laid-Open Publication No. 2009-62499 proposes a cross-linked resin cured by polymerizing, for example, a polyfunctional acrylate and a urethane acrylate.

Unfortunately, the surface layer composed of a cross-linked resin prepared from a copolymer of a polyfunctional acrylate and a urethane acrylate has less followability to the elastic layer, resulting in damages (e.g. cracking) at a bent portion of the surface layer during the circulation of the intermediate transferring belt.

Meanwhile, when the surface layer is composed of a soft material in order to improve the followability to the elastic layer, the surface layer may be scraped due to friction with materials in the apparatus or a sheet of paper (an image support) or due to plastic deformation by stress. The uneven surface layer results in uneven image density and reduces the quality of visible image.

SUMMARY OF THE INVENTION

The present invention has been attained in consideration of the circumstances described above. An object of the present invention is to provide an intermediate transferring belt, exhibiting followability to the elastic layer, excellent image transferability to a sheet of coarse paper, excellent scraping resistance, and sufficient cracking resistance. Another object of the present invention is to provide an image-forming apparatus including the intermediate transferring belt.

According to an aspect of the present invention, there is provided an intermediate transferring belt to be mounted in an electrophotographic image-forming apparatus, the intermediate transferring belt comprising, in sequence:

a substrate;

an elastic layer; and a surface layer, wherein the surface layer has an elongation of 5% or more and a stress of 5 MPa or more at an elastic limit determined by a stress-strain curve obtained according to JIS K7161.

Preferably, an elastic recovery rate of the elastic layer of the intermediate transferring belt according to the present invention is 70% or more.

Preferably, the intermediate transferring belt according to the present invention includes the surface layer includes a copolymer of a urethane acrylate and a monomer, wherein the monomer is different from the urethane acrylate and has an unsaturated double bond.

According to another aspect of the present invention, there is provided an electrophotographic image-forming apparatus including a primary transferring unit to primarily transfer an electrostatic toner image on an image retainer onto an intermediate transferring belt to be circulated; and a second transferring unit to secondarily transfer an intermediate toner image on the intermediate transferring belt onto an image support, wherein, the intermediate transferring belt is the above-described intermediate transferring belt.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

The present invention will now be described in detail.

[Intermediate Transferring Belt]

Figure 1:
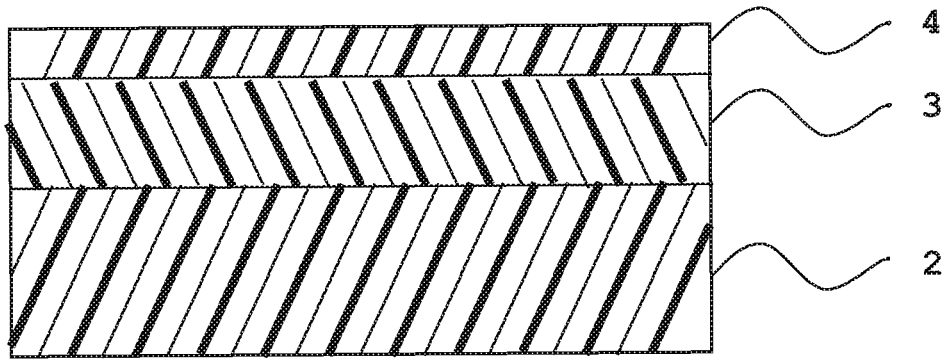
FIG. 1 is a cross-sectional view illustrating an exemplary configuration of an intermediate transferring belt according to the present invention.

The intermediate transferring belt of the present invention is in the form of, for example, an endless belt used in an electrophotographic image-forming apparatus. As illustrated in FIG. 1, the intermediate transferring belt includes a substrate 2, an elastic layer 3 disposed on the substrate 2, and a surface layer 4 disposed on the elastic layer 3.

[Substrate 2]

The substrate 2 of the intermediate transferring belt of the present invention, which is in the form of an endless belt for example, may have a monolayer or multilayer structure.

The substrate 2 may be composed of any material, and is preferably composed of a material having high strength and high durability, such as a polyimide (PI) resin, poly(amide-imide) (PAI) resin, poly(phenylene sulfide) (PPS) resin, or poly(ether-ether-ketone) (PEEK) resin.

Preferably, the substrate 2 has conductivity and is prepared by dispersion of a conductive filler in any one of the aforementioned resins.

The conductive filler may be, for example, carbon black or carbon nanotube.

The substrate 2 preferably has a thickness of 50 to 250 μm in view of mechanical strength and image quality.

[Elastic Layer 3]

The elastic layer 3 of the intermediate transferring belt of the present invention is composed of an elastic material. Examples of the elastic material include rubbers, elastomers, and resins. Particularly preferred are, for example, chloroprene rubber, nitrile-butadiene rubber, and hydrogenated nitrile-butadiene rubber in view of hardness and durability.

These elastic materials may be used alone or in combination.

The elastic recovery rate of the elastic layer 3 is preferably 70% or more.

When the elastic recovery rate of the elastic layer 3 is less than 70%, the aforementioned effects cannot be provided efficiently and the elastic layer might be deformed plastically. The resulting defective cleaning may reduce the quality of formed images.

The elastic recovery rate of the elastic layer 3 is determined for the elastic layer 3 disposed on the substrate 2 before forming the surface layer, using the following expression:

$$\text{elastic recovery rate } (We)=(Wt-Wr)/Wt$$

In the above expression, a displacement (Wt) is measured after 5 seconds from application of a load of 2.0 mN on the elastic layer 3 in 30 seconds, and a displacement (Wr) is measured after 5 seconds from removal of the load in 30 seconds. Wt and Wr are measured using "HM100" (manufactured by Fischer Instrument, K. K.).

The hardness of the elastic layer 3 is "JIS A hardness" determined according to JIS K3601 (old JIS) and is preferably within the range of 60 to 70.

The elastic layer 3 preferably has a thickness of 200 to 500 μm in view of mechanical strength and image quality.

[Surface layer 4]

The surface layer 4 of the intermediate transferring belt of the present invention has an elongation at an elastic limit determined by a stress-strain curve obtained according to JIS K7161 (hereinafter may be referred to as an "elongation at the elastic limit") of 5% or more, and has a stress at an elastic limit determined by the stress-strain curve (hereinafter may be referred to as a "stress at the elastic limit") of 5 MPa or more.

The surface layer 4 having an elongation at the elastic limit of 5% or more exhibits excellent scraping resistance, because plastic deformation (deformation due to stress) of the surface layer 4 can be suppressed. The surface layer 4 having a stress at the elastic limit of 5 MPa or more can exhibit improved scraping resistance because the plastic deformation of the surface layer 4 can be suppressed, and can suppress cracking at the bent portion of the surface layer 4 during the circulation of the intermediate transferring belt.

The elastic modulus of the surface layer 4 is preferably 200 MPa or more and 1, 500 MPa or less.

The surface layer 4 having an elastic modulus falling within the above range can reduce scraping due to friction and ensure the quality of formed images. The higher the elastic modulus of the surface layer is, the less scraping is generated. The elastic modulus is preferably 1, 500 MPa or less, in view of improving image transferability onto an image support by maintaining followability to the elastic layer.

The elongation at the elastic limit and the stress at the elastic limit and the elastic modulus are determined for the surface layer 4 formed as a single layer at the elastic limit which is determined by a stress-strain curve obtained according to JIS K7161. The elastic limit is the maximum value of stress, whose application generates strain (elongation) of the surface layer and whose removal returns the strained (extended) surface layer to its original size. The elastic modulus is defined as the proportional constant between the elongation at the elastic limit and the stress at the elastic limit.

The surface layer 4 is composed of any resin that can provide an elongation at the elastic limit of more than 5% and stress at the elastic limit of 5 MPa or more. Preferable example of such resin includes a copolymer (hereinafter may be referred to as a "specific copolymer") of (A) a urethane acrylate and (B) a monomer (hereinafter may be referred to as " (B) a specific monomer with an unsaturated double bond (s) ") which is different from the urethane acrylate and has an unsaturated double bond(s).

[(A) Urethane Acrylate]

(A) urethane acrylate may be any compound having a urethane bond and one or more acryloyloxy groups per molecule.

(A) urethane acrylate may be, for example, an oligomer or a polymer having a urethane bond in the main chain and at least one acryloyloxy group bonded to an end of the main chain or to a side chain.

(A) urethane acrylate of the present invention preferably has a functional group which can facilitate intermolecular aggregation. Such urethane acrylate can provide a surface layer 4 having a large elongation at the elastic limit.

Example of the functional group which facilitates the intermolecular aggregation include a group having a cyclic structure, such as a phenyl group, a naphthyl group, and a cyclohexyl group.

Example of a monomer to form (A) urethane acrylate in order to introduce functional group which can facilitate the intermolecular aggregation includes isophthalic acid and 4, 4'-biphenyldicarboxylic acid.

In the present invention, the elongation at the elastic limit and the stress at the elastic limit can be adjusted by controlling the amount of the functional group which can facilitate the intermolecular aggregation and the amount of the acryloyloxy group introduced to (A) urethane acrylate. Specifically, the stress at the elastic limit can be reduced and the elastic modulus can be increased by increasing the amount of functional group which can facilitate the intermolecular aggregation in the specific copolymer constituting the surface layer.

(A) urethane acrylate has a weight average molecular weight of preferably 1,000 or more and 20,000 or less, particularly preferably 3,000 or more and 10,000 or less.

The use of (A) urethane acrylate having a weight average molecular weight falling within the above range can ensure flexibility and extensibility of the specific copolymer and prevent reduction of the strength.

The weight average molecular weight of (A) urethane acrylate is determined by gel permeation chromatography.

The aforementioned urethane acrylates may be used alone or in combination.

[(B) Specific Monomer with an Unsaturated Double Bond(s)]

(B) specific monomer with an unsaturated double bond(s) has one or more unsaturated double bonds per molecule and preferably includes acryloyloxy group. (B) specific monomer with an unsaturated double bond(s) is particularly preferably a polyfunctional acrylate including two or more acryloyloxy groups per molecule.

A polyfunctional acrylate includes a bifunctional acrylate such as bis(2-acryloyloxyethyl)-hydroxyethyl-isocyanurate, 1,6-hexanediol diacrylate, 1,4-butanediol diacrylate, 1,9-nonanediol diacrylate, neopentyl glycol diacrylate, and hydroxypivalate neopentyl glycol diacrylate; and a trifunctional or higher functional acrylate such as trimethylol propane triacrylate (TMPTA), pentaerythritol triacrylate, tris(acryloyloxyethyl) isocyanurate, ditrimethylolpropane tetraacrylate, pentaerythritol tetraacrylate (PETTA), dipentaerythritol hexaacrylate (DPHA), and an ester compound synthesized from polyhydric alcohol, polybasic acid, and acrylic acid (for example, Trimethylolethane/succinic acid/acrylic acid=2/1/4 (molar ratio)).

(B) specific monomer with an unsaturated double bond(s) as described above may be used alone or in combination.

In the present invention, the elongation at the elastic limit and the stress at the elastic limit can be adjusted by controlling the number of acryloyloxy groups in (B) specific monomer with an unsaturated double bond(s). Specifically, the elastic modulus of the surface layer can be decreased by reducing the number of acryloyloxy groups in the specific copolymer of the surface layer.

The copolymerization ratio (mass ratio) of (A) urethane acrylate to (B) specific monomer with an unsaturated double bond (s) is preferably 30/70 to 70/30 in the copolymer contained in the above specific copolymer.

The specific copolymer may contain a copolymer of (A) urethane acrylate, (B) specific monomer with an unsaturated double bond(s), and an additional polymerizable component. The additional polymerizable component may be incorporated in a small amount such that the component does not adversely affect cracking resistance or scraping resistance.

The surface layer 4 may optionally contain an additive, such as an organic solvent, a photostabilizer, a UV absorbent, a catalyst, a colorant, an antistatic agent, a lubricant, a leveling agent, an antifoaming agent, a polymerization promoter, an antioxidant, a flame retardant, an IR absorbent, a surfactant, or a surface modifier.

The surface layer 4 has a thickness of preferably 0.5 to 10 μm, more preferably 0.5 to 5 μm, in view of mechanical strength and image quality.

The aforementioned intermediate transferring belt exhibits followability to the elastic layer, excellent image transferability to a sheet of coarse paper, excellent scraping resistance, and sufficient cracking resistance, because the elongation at the elastic limit and the stress at the elastic limit fall within the specific range.

[Production of Intermediate Transferring Belt]

The intermediate transferring belt of the present invention is produced through, for example, the following procedure: A coating solution for formation of an elastic layer is applied to the substrate 2, and the resultant coating film is dried, to form the elastic layer 3. A coating solution containing a polymerization initiator and a polymerizable component containing (A) urethane acrylate and (B) specific monomer with an unsaturated double bond(s) (hereinafter the coating solution may be referred to as "coating solution for formation of a surface layer") is applied to the elastic layer 3, and the resultant coating film is irradiated with active energy rays for polymerization of the polymerizable component, to form the surface layer 4.

The substrate 2 from a polyimide resin may be prepared according to any appropriate conventional process. For example, a polyamic acid solution is formed into a ring-shaped layer through a process involving application of the solution to the outer surface of a cylindrical mold, a process involving application of the solution to the inner surface of the mold, a process further centrifuging the above, or a process involving filling of a casting mold with the solution. The resultant layer is dried and shaped into a belt-like product, and the product is heated to convert the polyamic acid into an imide, followed by recovery of the resultant product from the mold (see, for example, Japanese Patent Application Laid-Open Publication Nos. S61-95361, S64-22514, and H03-180309). The preparation of an endless-belt substrate may involve any appropriate process, such as a mold releasing process or a defoaming process.

The coating solution for formation of an elastic layer is prepared by addition of a material for the elastic layer to a solvent in an amount of 20 to 30 mass % (in terms of solid content).

The coating solution for formation of an elastic layer is applied through dipping, for example.

The coating solution for formation of a surface layer may contain any polymerization initiator that can initiate polymerization of the polymerizable component with active energy rays, such as light.

The polymerization initiator may be a photopolymerization initiator, such as acetophenone compounds, benzoin ether compounds, benzophenone compounds, sulfur compounds, azo compounds, peroxide compounds, and phosphine oxide compounds.

Specific examples of the polymerization initiator include carbonyl compounds, such as benzoin, benzoin methyl ether, benzoin ethyl ether, benzoin isopropyl ether, acetoin, butyroin, toluoin, benzil, benzophenone, p-methoxybenzophenone, diethoxyacetophenone, α,α-dimethoxy-α-phenylacetophenone, methyl phenylglyoxylate, ethyl phenylglyoxylate, 4,4'-bis(dimethylaminobenzophenone), 2-hydroxy-2-methyl-1-phenylpropane-1-one, 2,2-dimethoxy-1,2-diphenylethan-1-one, and 1-hydroxycyclohexyl phenyl ketone; sulfur compounds, such as tetramethylthiuram monosulfide and tetramethylthiuram disulfide; azo compounds, such as azobisisobutyronitrile and azobis-2,4-dimethylvaleronitrile; and peroxide compounds, such as benzoyl peroxide and di-t-butyl peroxide. These polymerization initiators may be used alone or in combination.

Preferred are 1-hydroxycyclohexyl phenyl ketone, 2-hydroxy-2-methyl-1-phenylpropane-1-one, and 1-[4-(2-hydroxyethoxy)-phenyl]-2-hydroxy-2-methyl-1-propane-1-one, in view of photostability, highly efficient photocleavage, surface curability, compatibility with a specific copolymer, low volatility, and low odor.

The coating solution for formation of a surface layer preferably contains a polymerization initiator in an amount of 1 to 10 mass %. The amount of the polymerization initiator is more preferably 2 to 8 mass %, still more preferably 3 to 6 mass %, in view of high curability, sufficient hardness of the resultant surface layer, and high adhesion of the surface layer to the elastic layer.

The coating solution for formation of a surface layer preferably contains a solvent in view of an improvement in applicability (workability).

Specific examples of the solvent include ethanol, isopropanol, butanol, toluene, xylene, acetone, methyl ethyl ketone, ethyl acetate, butyl acetate, ethylene glycol diethyl ether, and propylene glycol monomethyl ether acetate.

The coating solution for formation of a surface layer may be prepared by dissolution or dispersion, in a solvent, of a polymerizable component containing (A) urethane acrylate and (B) specific monomer with an unsaturated double bond(s), a polymerization initiator, and an optional additive.

The coating solution for formation of a surface layer preferably has a viscosity of 10 to 100 cP.

The coating solution for formation of a surface layer preferably has a solid content of 5 to 40 mass %. In the coating solution for formation of a surface layer, the solid content corresponds to the polymerizable component including (A) urethane acrylate and (B) specific monomer with an unsaturated double bond(s).

The coating solution for formation of a surface layer is applied through, for example, dip coating or spray coating.

The polymerizable component is cured through irradiation with active energy rays, for example.

The active energy rays may be, for example, UV rays, electron beams, or γ-rays. Preferred are UV rays in view of easy handling and availability of high energy. Any UV source may be used. Examples of the UV source include low-pressure mercury lamps, middle-pressure mercury lamps, high-pressure mercury lamps, ultrahigh-pressure mercury lamps, carbon-arc lamps, metal halide lamps, and xenon lamps. The source of active energy rays may be, for example, an ArF excimer laser, a KrF excimer laser, an excimer lamp, or a synchrotron radiation source. A UV laser is preferably used for application of active energy rays in a spotted pattern.

The conditions of irradiation with active energy rays may vary depending on the type of the active energy ray source. The dose of active energy rays is preferably 500 mJ/cm$^2$ or more, more preferably 0.5 to 5 J/cm$^2$, particularly preferably 1 to 3 J/cm$^2$, in view of even curing, hardness, curing time, and curing speed.

The dose of active energy rays is determined with an accumulated UV meter UIT-250 (manufactured by USHIO INC.)

The time of irradiation with active energy rays is preferably 10 seconds to 8 minutes, more preferably 30 seconds to 5 minutes, in view of curing or operational efficiency.

The polymerizable component may be cured in an air atmosphere through irradiation with active energy rays. The oxygen concentration of the atmosphere is preferably 1% or less, particularly preferably 500 ppm or less, in view of even curing and curing time. Such an oxygen concentration is effectively achieved by introduction of nitrogen gas into the atmosphere during irradiation with active energy rays.

The oxygen concentration is determined with an oxygen analyzer for monitoring environmental gas "OX100" (manufactured by Yokogawa Electric Corporation).

Preferably, the coating solution for formation of a surface layer is applied to the elastic layer and then the coating film is dried to remove the solvent.

The coating film may be dried before, during, or after the polymerization of the polymerizable component. The process can be suitably selected and combined. Preferably, a first drying process is performed until the coating film loses its fluidity, the polymerizable component is then polymerized, and a second drying process is then performed for adjusting the amount of the volatile material contained in the surface layer to a specific level.

The coating film may be dried by a process that is appropriately selected depending on the type of the solvent and the thickness of the surface layer to be formed. The drying temperature is preferably, for example, 60 to 120° C., more preferably 60 to 100° C. The drying time is preferably, for example, 1 to 10 minutes, more preferably about five minutes.

[Image-Forming Apparatus]

The image-forming apparatus of the present invention includes the intermediate transferring belt. The image-forming apparatus of the present invention may be of any known electrophotographic type, such as a monochromatic or full-color image-forming apparatus.

Figure 2:
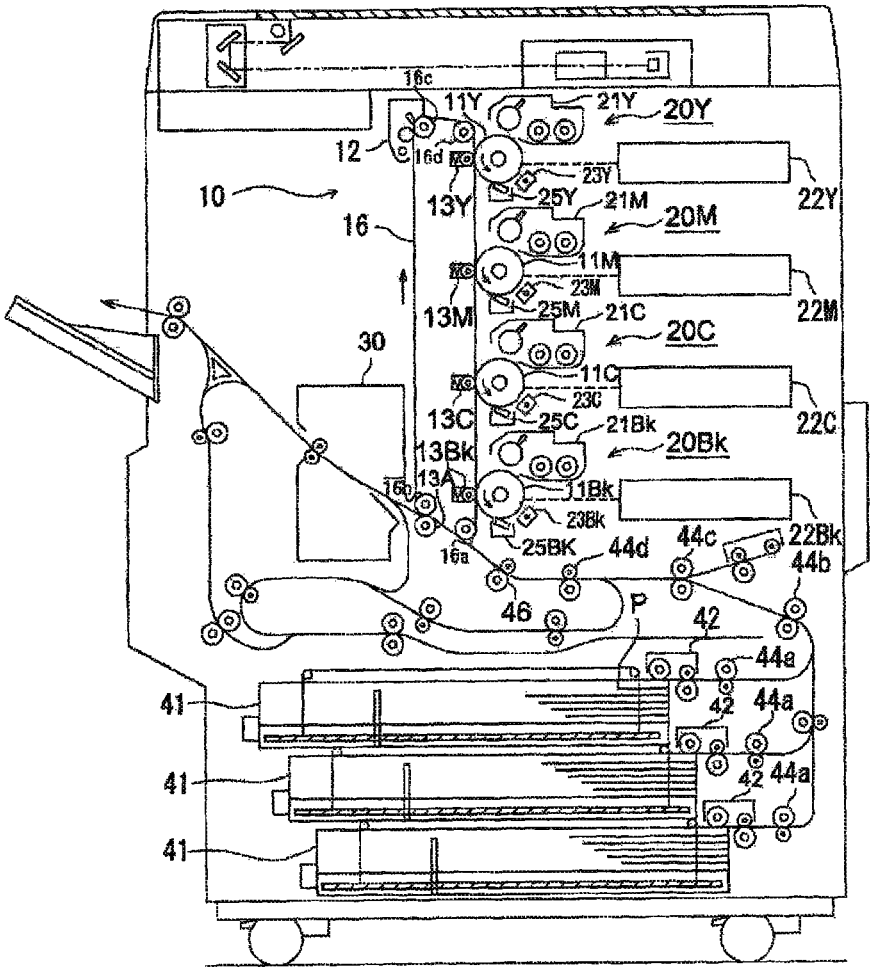
FIG. 2 is a cross-sectional view illustrating an exemplary configuration of an image-forming apparatus according to the present invention.

FIG. 2 is a cross-sectional view illustrating an exemplary configuration of the image-forming apparatus of the present invention.

The image-forming apparatus includes image-forming units 20Y, 20M, 20C, and 20Bk; an intermediate transferring unit 10 for transferring toner images formed by the image-forming units 20Y, 20M, 20C, and 20Bk onto an image support P; and a fixing unit 30 for fixing the toner images onto the image support P through heating and application of pressure.

The image-forming unit 20Y forms a yellow toner image, the image-forming unit 20M forms a magenta toner image, the image-forming unit 20C forms a cyan toner image, and the image-forming unit 20Bk forms a black toner image.

The image-forming units 20Y, 20M, 20C, and 20Bk respectively include photoreceptors (i.e. image retainers) 11Y, 11M, 11C, and 11Bk; charging units 23Y, 23M, 23C, and 23Bk for proving the surfaces of the photoreceptors 11Y, 11M, 11C, and 11Bk with a uniform potential; exposing units 22Y, 22M, 22C, and 22Bk for forming electrostatic latent images of desired patterns on the uniformly charged photoreceptors 11Y, 11M, 11C, and 11Bk; developing units 21Y, 21M, 21C, and 21Bk for transferring color toners onto the photoreceptors 11Y, 11M, 11C, and 11Bk to develop the electrostatic latent images into toner images; and cleaning units 25Y, 25M, 25C, and 25Bk for recovering toners remaining on the photoreceptors 11Y, 11M, 11C, and 11Bk after the first transferring process.

The intermediate transferring unit 10 includes a circulating intermediate transferring belt 16; primary transferring rollers (primary transferring units) 13Y, 13M, 13C, and 13Bk for primarily transferring toner images formed by the image-forming units 20Y, 20M, 20C, and 20Bk onto the intermediate transferring belt 16; a second transferring roller (a second transferring unit) 13A for secondarily transferring the intermediate toner images on the intermediate transferring belt 16 formed (transferred) from the first transferring rollers 13Y, 13M, 13C, and 13Bk onto the image support P; and a cleaning unit 12 for recovering the toner remaining on the intermediate transferring belt 16.

The intermediate transferring belt of the present invention is used as the intermediate transferring belt 16.

The intermediate transferring belt 16, which is in the form of an endless belt, is strained and rotatably supported by multiple supporting rollers 16*a* to 16*d*.

The intermediate transferring belt 16 includes a substrate 2, an elastic layer 3 disposed on the outer surface of the substrate 2, and a surface layer 4 disposed on the elastic layer 3 and composed of a specific copolymer.

The color toner images formed by the image-forming units 20Y, 20M, 20C, and 20Bk are sequentially transferred onto the circulating endless intermediate transferring belt 16 with the first transferring rollers 13Y, 13M, 13C, and 13Bk, to form a superimposed color image. The image support P accommodated in a sheet feeding cassette 41 is fed by a sheet feeding unit 42, and is transported to the second transferring roller (second transferring unit) 13A via multiple intermediate rollers 44*a* to 44*d* and register rollers 46. The color image on the intermediate transferring belt 16 is transferred onto the image support P.

The color image transferred onto the image support P is fixed by the fixing unit 30 equipped with a thermal fixing roller. The image support P is then pinched between discharging rollers and is conveyed to a sheet receiving tray provided outside of the apparatus.

After the transfer of the color image onto the image support P with the second transferring roller 13A and the self-stripping of the image support P, the toner remaining on the endless intermediate transferring belt 16 is removed by the cleaning unit 12.

According to the image-forming apparatus including the intermediate transferring belt, image transferability to a sheet of coarse paper is excellent, and the intermediate transferring belt exhibits followability to the elastic layer, excellent scraping resistance, and sufficient cracking resistance.

[Developer]

The developer used in the image-forming apparatus of the present invention may be a one-component developer containing a magnetic or non-magnetic toner, or a two-component developer containing a toner and a carrier.

The developer may contain any known toner, and preferably contains a polymerized toner prepared through a polymerization process and having a volume median particle size of 3 to 9 μm. The use of such a polymerized toner achieves high resolution and even image density in the resultant image and prevents image fogging.

The two-component developer may contain any known carrier, and preferably contains a ferrite carrier composed of magnetic particles having a volume median particle size of 30 to 65 μm and a magnetization of 20 to 70 emu/g. The use of a carrier having a volume median particle size of less than 30 μm may lead to deposition of the carrier, resulting in an image with voids. The use of a carrier having a volume median particle size exceeding 65 μm may lead to formation of an image with uneven image density.

[Image support]

Examples of the image support P used in the image-forming apparatus of the present invention include, but are not limited to, sheets of plain paper (including thin paper and thick paper), high-quality paper, coated printing paper (e.g., art paper and coated paper), and coarse paper (e.g., commercially available Japanese paper, postcard, and Leathac paper); plastic films for OHP; and fabrics.

The image-forming apparatus, which includes the intermediate transferring belt of the present invention, exhibits excellent image transferability to a sheet of coarse paper, such as Leathac paper used as the image support P.

The present invention should not be limited to the above-described embodiments, and may include various modifications.

EXAMPLES

The present invention will now be described in detail by way of Examples, which should not be construed as limiting the invention thereto.

[Synthesis of polyurethane acrylate oligomer A]

In a reactor equipped with a condenser, a thermometer, a stirrer, a dropping funnel, and an air injection pipe, 167 g of polypropyleneglycol (molecular weight: 2,000 MW), 4.86 g of 2-hydroxyethyl acrylate, 5.79 g of isophthalic acid, 0.5 g of p-methoxyphenol as a polymerization inhibitor, and 0.05 g of dibutyltin dilaurate as a catalyst were added. The temperature was increased to 70° C. while allowing air to flow into the reactor. Thereafter, 26.3 g of isophorone diisocyanate was added dropwise and uniformly in two hours with stirring at the temperature of 70-75° C. for carrying out the synthetic reaction. After completion of dropping, the synthetic reaction was carried out for 5 hours. The synthetic reaction was finished when the isocyanate was confirmed to be vanished by IR measurement. The obtained polyurethane acrylate oligomer [A] had polypropylene glycol, isophthalic acid, and isophorone diisocyanate as repeating units and had an unsaturated double bond(s) at both terminals as a polymerizable component.

[Synthesis of polyurethane acrylate oligomer [B] ]

Polyurethane acrylate oligomer [B] was produced as in the synthesis of polyurethane acrylate oligomer [A], except that contents of the monomers were replaced with those shown in Table 1.

[Synthesis of polyurethane acrylate oligomer [C] ]

Polyurethane acrylate oligomer [C] was produced as in the synthesis of polyurethane acrylate oligomer [A], except that contents of the monomers were replaced with those shown in Table 1.

TABLE 1

| | Polyurethane acrylate oligomer | | |
|---|---|---|---|
| | [A] | [B] | [C] |
| Polypropyleneglycol | 167 g | 174 g | 159 g |
| 2-hydroxyethyl acrylate | 4.86 g | 10.9 g | 5.50 g |
| Isophthalic acid | 5.79 g | — | 10.5 |
| Isophorone diisocyanate | 26.3 g | 19.3 g | 29.7 g |
| Weight average molecular weight | 10,000 | 3,000 | 10,000 |

Example 1

Production of Intermediate Transferring Belt [1]

(1) Preparation of Substrate

The belt used in "bizhub PRESS C1100" (manufactured by KONICA MINOLTA, INC.) was provided as a substrate. The belt served as endless-belt substrate [1].

(2) Formation of Elastic Layer

Carbon black was kneaded together with chloroprene rubber, and the resultant compound was dissolved or dispersed in toluene, to prepare coating solution [1] for formation of an elastic layer.

Coating solution [1] for formation of an elastic layer was applied to the outer surface of endless-belt substrate [1] by dip coating and then dried to form elastic layer [1] having a dry thickness of 200 μm.

(3) Formation of Surface Layer (3-1) Preparation of Coating Solution for Formation of a Surface Layer The following monomer composition, oligomer, and a polymerization initiator were added to and dissolved in a solvent, to prepare coating solution [1] for formation of a surface layer.

| | |
|---|---|
| pentaerythritol triacrylate | 50 parts by mass |
| polyurethane acrylate oligomer [A] | 50 parts by mass |
| a polymerization initiator: "IRGACURE 184" (made by BASF) | 4 parts by mass |

(3-2) Formation of Surface Layer

Coating solution [1] for formation of a surface layer was applied to the outer surface of the aforementioned elastic layer [1] by dip coating with a coating device, to forma coating film having a dry thickness of 2 μm. The coating film was irradiated with UV rays under the conditions described below, to cure the coating film to form a surface layer. Intermediate transferring belt [1] was thereby produced.

—Condition for Irradiation with UV Rays—

Light source: high-pressure mercury lamp "H04-L41" (manufactured by EYE GRAPHICS CO., LTD.)

Distance between the irradiation port and the surface of the coating film: 100 mm Dose: 1 J/cm$^2$ Moving speed (circumferential speed) of the coating film relative to the fixed light source: 60 mm/second Irradiation time (time of rotation of the coating film): 240 seconds

Examples 2 to 4 and Comparative Examples 1 and 2

Production of intermediate transferring belts [2] to [6]

Intermediate transferring belts [2] to [6] were produced as in intermediate transferring belt [1], except that the monomer composition and oligomer for formation of a surface layer was replaced with that shown in Table 2.

Surface layers of the intermediate transferring belts [1] to [6] were formed as a single film. The elongation at the elastic limit, stress at the elastic limit, and elastic modulus were determined for each film, as described above. The results are shown in Table 2.

Elastic layers of the intermediate transferring belts [1] to [6] were formed as a single film. The elastic recovery rate for the elastic layer was determined for each film on the substrate, as described above. The results are shown in Table 2.

—Criteria of Evaluation—

A: Ten-point average surface roughness (Rz) is less than 1.0 μm (passed)

B: Ten-point average surface roughness (Rz) is 1.0 μm or more (not passed)

Ten-point average surface roughness (Rz) of less than 1.0 μm does not practically affect the quality of formed image. Meanwhile, ten-point average surface roughness (Rz) of 1.0 μm or more results in uneven image density in the low density portion of a halftone image and the like.

(2) Evaluation of Cracking Resistance

After the aforementioned durability test, the number of cracks was counted in any 10 unit areas (1 mm$^2$) in each intermediate transferring belt to determine an average number of cracks per unit area. The intermediate transferring belt was evaluated for cracking resistance on the basis of the criteria described below. The results are shown in Table 3.

—Criteria of Evaluation—

A: Average number of cracks of 0 (passed)

B: Average number of cracks of more than 0 and less than 10 (passed)

C: Average number of cracks of 10 or more (not passed)

(3) Evaluation of Image Transferability to Coarse Paper

Intermediate transferring belts [1] to [6] were each mounted in an image-forming apparatus "bizhub PRESS C1100" (manufactured by KONICA MINOLTA, INC.), and a solid image (toner density: 100%) was printed with each apparatus on 10 sheets of Leathac paper (coarse paper).

Each of the printed solid images was digitized with a scanner, and subjected to image processing with image editing and processing software "Photoshop" (manufactured by Adobe Systems), to determine an average image density of the solid image. The area percentage of regions with an image density of 90% or less of the average image density was determined in each solid image, and the resultant area percentages were averaged for each intermediate transferring belt (hereinafter the averaged percentage will be referred to as "percentage of region with 90% or less image density"). The intermediate transferring belt was evaluated for image transferability on the basis of the criteria described below. The results are shown in Table 3.

—Criteria of Evaluation—

A: An area percentage of regions with 90% or less image density of 1% or less (passed)

TABLE 2

| | | Polymerizable component | | | | Property: Surface layer | | | Property: Elastic layer |
|---|---|---|---|---|---|---|---|---|---|
| | Intermediate transferring belt No. | Monomer with unsaturated double bonds | Amount [Parts by mass] | Polyurethane acrylate oligomer | Amount [Parts by mass] | Extension at an elastic limit [%] | Stress at an elastic limit [MPa] | Elastic modulus [MPa] | Elastic recovery rate [%] |
| Example 1 | [1] | pentaerythritol triacrylate | 50 | [A] | 50 | 7 | 17 | 430 | 80 |
| Example 2 | [2] | 1,6-hexanediol diacrylate | 50 | [A] | 50 | 9 | 25 | 210 | 72 |
| Example 3 | [3] | ditrimethylolpropane tetraacrylate | 50 | [A] | 50 | 6 | 6 | 1,400 | 93 |
| Example 4 | [4] | pentaerythritol triacrylate | 50 | [A] | 50 | 7 | 17 | 430 | 50 |
| Comparative Example 1 | [5] | pentaerythritol triacrylate | 50 | [B] | 50 | 4 | 6 | 280 | 80 |
| Comparative Example 2 | [6] | pentaerythritol triacrylate | 50 | [C] | 50 | 6 | 4 | 1,600 | 80 |

(1) Evaluation of Scraping Resistance

Intermediate transferring belts [1] to [6] were each mounted in an image-forming apparatus "bizhub PRESS C1100" (manufactured by KONICA MINOLTA, INC.), and an image with a coverage rate of 10% was printed on 1,000,000 sheets. After this durability test, ten-point average surface roughness (Rz) of the intermediate transferring belt was measured according to JIS B0601 and evaluated the scraping resistance on the basis of the criteria described below. The results are shown in Table 3.

B: An area percentage of regions with 90% or less image density of 3% or less (passed)

C: An area percentage of regions with 90% or less image density of more than 3% and 5% or less (passed)

D: An area percentage of regions with 90% or less image density of more than 5% (not passed)

TABLE 3

| | Intermediate transferring belt No. | Result of evaluation | | |
|---|---|---|---|---|
| | | Cracking resistance | Scraping resistance | Transferability to a sheet of coarse paper |
| Example 1 | [1] | A | A | B |
| Example 2 | [2] | A | A | A |
| Example 3 | [3] | A | A | B |
| Example 4 | [4] | A | B | C |
| Comparative Example 1 | [5] | C | A | C |
| Comparative Example 2 | [6] | A | C | D |

As shown in Table 3, the intermediate transferring belts [1] to [4] having the configuration of the present invention passed all evaluation items, according to Examples 1-4. Meanwhile, according to Comparative Examples 1 and 2, the intermediate transferring belts [5] and [6] without the configuration of the present invention did not pass all evaluation items.

What is claimed is:

1. An intermediate transferring belt to be mounted in an electrophotographic image-forming apparatus, the intermediate transferring belt comprising, in sequence:

a substrate;

an elastic layer; and a resin surface layer, wherein the resin surface layer has an elongation of 5% or more and a stress of 5 MPa or more at an elastic limit determined by a stress-strain curve obtained according to JIS K7161.

2. The intermediate transferring belt according to claim 1, wherein an elastic recovery rate of the elastic layer is 70% or more.

3. The intermediate transferring belt according to claim 1, wherein the surface resin layer comprises a copolymer of a urethane acrylate and a monomer, wherein the monomer is different from the urethane acrylate and has ae unsaturated double bond.

4. An electrophotographic image-forming apparatus comprising:

a primary transferring unit to primarily transfer an electrostatic toner image on an image retainer onto an intermediate transferring belt to be circulated; and a second transferring unit to secondarily transfer an intermediate toner image on the intermediate transferring belt onto an image support, wherein, the intermediate transferring belt is the intermediate transferring belt according to claim 1.

5. The intermediate transferring belt according to claim 1, wherein the surface resin layer is an outermost layer of the belt.

* * * * *